United States Patent [19]

Deborde et al.

[11] 4,448,223

[45] May 15, 1984

[54] DEVICE COMPRISING A MOVABLE NOZZLE FOR THE PNEUMATIC INSERTION OF THE WEFT IN A SHUTTLE-LESS LOOM

[75] Inventors: Albert H. Deborde; Pierre L. Rémond, both of Bourgoin Jailleu, France

[73] Assignee: Saurer Diederichs (Societe Anonyme), Bourgoin Jailleu, France

[21] Appl. No.: 331,922

[22] Filed: Dec. 17, 1981

[30] Foreign Application Priority Data

Dec. 30, 1980 [FR] France ..... 80 27964

[51] Int. Cl.[3] ..... D03D 47/36

[52] U.S. Cl. ..... 139/435; 139/450; 139/1 E

[58] Field of Search ..... 139/1 R, 1.4, 435, 429, 139/450; 226/97

[56] References Cited

U.S. PATENT DOCUMENTS

| | | | |
|---|---|---|---|
| 3,229,725 | 1/1966 | Saito | 139/435 |
| 3,938,561 | 2/1976 | Scheffel | 139/435 |
| 4,326,565 | 4/1982 | Van Mullekom | 139/435 |

FOREIGN PATENT DOCUMENTS

| | | |
|---|---|---|
| 2348297 | 11/1977 | France . |
| 510765 | 9/1971 | Switzerland . |
| 609106 | 2/1979 | Switzerland . |
| 1322518 | 7/1973 | United Kingdom . |
| 1357172 | 6/1974 | United Kingdom . |
| 1570426 | 7/1980 | United Kingdom . |

OTHER PUBLICATIONS

Blueprint from Saurer-Diederichs.

*Primary Examiner*—Henry Jaudon

*Attorney, Agent, or Firm*—Karl F. Ross; Herbert Dubno

[57] ABSTRACT

The weft insertion nozzle is mounted on an extension of the sley sole, and the nozzle is pivotable about an axis perpendicular to the sley sole. The nozzle is connected to a fixed point of the loom by means of a retractable connecting-rod. Due to the action of this connecting-rod, the nozzle is in a position parallel to the sley sole during insertion of a pick of weft into the shed, but forms an angle with sley sole in the beating-up position of the sley, at which the weft is cut by scissors. A pneumatic jack supported by the sley sole can also cause the weft insertion nozzle to pivot by retracting the connecting-rod, in order to deflect the weft by directing the weft from the nozzle into a suction mouthpiece so as to prevent insertion of a pick into the shed when a fault is detected causing the stoppage of the machine.

12 Claims, 8 Drawing Figures

15
43
42
13
40
41
26
38
39
22
35
37
36
33
32
34
14
19
20
21
23
10
α
47
48
46

DEVICE COMPRISING A MOVABLE NOZZLE FOR THE PNEUMATIC INSERTION OF THE WEFT IN A SHUTTLE-LESS LOOM

FIELD OF THE INVENTION

This invention relates to a device comprising a movable nozzle for the pneumatic insertion of the weft in a shuttle-less weaving loom.

The invention constitutes more particularly an improvement to looms with pneumatic transfer of the weft, comprising a main insertion nozzle mounted on the sley and located at a side of the machine, which serves to introduce the weft thread into a channel defined by the teeth of a confiner reed, which may comprise "relay" nozzles contributing to the entrainment of the weft thread during its insertion.

BACKGROUND OF THE INVENTION

During the pneumatic insertion of the weft thread, the orifice of the main nozzle should be located as close as possible to the entrance to the channel defined by the teeth of the confiner reed. On the other hand, after the insertion of a pick, it is desirable to engage the thread in the cutting scissors, which requires a certain retraction of the nozzle during the forward movement of the sley. In view of these functional necessities, weft insertion nozzles having a certain mobility have already been designed. Thus, a telescopic nozzle system is known which is controlled through the intermediary of a cable which causes the retraction of the nozzle upon the forward movement of the sley. Nozzles also have been mounted to slide along their axis.

OBJECT OF THE INVENTION

An object of the invention is to provide a different but simpler solution for mounting and controlling the retraction of a movable weft insertion nozzle.

SUMMARY OF THE INVENTION

According to the invention there is provided a device comprising a movable nozzle for the pneumatic insertion of the weft in a shuttle-less weaving loom, whereby the insertion nozzle is mounted to pivot on an extension of a sley sole about an axis perpendicular to the sley sole and the nozzle is connected to a fixed point of the loom by means of a connecting-rod, so that the nozzle has a position parallel to the sley sole during the insertion of the weft thread, but forms an angle with respect to the longitudinal direction of the sley sole, in the beating-up position of the sley.

Thus, retraction of the nozzle is effected by a pivoting movement controlled mechanically from the oscillation movement of the sley, by virtue of the connection ensured by the connecting-rod between a point of the nozzle and said fixed point of the loom. This pivoting of the nozzle, starting from a position parallel to the sley sole, is accompanied by an increase in the distance between the orifice of the nozzle and a selvedge of the fabric, making it possible to engage the weft thread in weft cutting scissors located close to the selvedge. This mechanism is moreover simple, light and rigid, which is important in view of the fact that it is mounted on the moving sley.

The pivotal mounting of the weft insertion nozzle makes it possible to deflect the weft thread to prevent it from being inserted in the shed of the warp threads under certain circumstances. The necessity for eliminating certain picks results:

- on the one hand from the fact that looms of the type in question comprise, upstream of the insertion nozzle, a continuously operating weft delivery roll, synchronized with the loom and which cannot be put out of action;
- on the other hand, by reason that these looms, currently rotating at high speeds (of the order of 600 strokes per minute for example), start up and stop in a rotation of between 1 and 2 revolutions.

Under these conditions, during acceleration on starting-up the loom, or during deceleration on stopping the loom, the first or last pick inserted would be beatenup at an insufficient speed, thus causing a defect in the fabric, especially in the case of delicate textiles, if the pick were not eliminated.

In order to eliminate this pick the extension of the sley sole, on which the weft insertion nozzle is pivotally mounted, also supports a jack to control pivoting of the nozzle about the above-mentioned axis so as to deflect the weft thread so as not to insert the pick into the shed, upon detection of a fault emanating from deceleration and stoppage of the loom. The connecting rod is displaceable with respect to at least one of its pivots in order to facilitate the pivoting of the insertion nozzle under the command of the jack, in any position of the sley. These additional arrangements make it possible to eliminate at least one pick, at the time of an automatic stoppage of the loom due to the breaking of a warp thread or of the weft thread detected by known inspection means, as well as in the case of manual stoppage. The connecting rod is provided to be retractable in order that the pivoting of the nozzle under the action of the jack takes place completely and immediately, the normal oscillation movement of the nozzle, which would be brought about by a connecting rod of invariable length, (or fixed relation to its pivots) thus being neutralized.

Preferably, in order to ensure a real "ejection" of a pick which is not to be inserted between the sheets of warp threads, suction means are mounted on the reed in a position such that the pivoting of the insertion nozzle under the command of the jack brings the orifice of this nozzle into the vicinity of the inlet orifice of said suction means.

In a particular embodiment, the jack is a double-acting pneumatic jack having a rod comprising a head which cooperates, in the manner of a push-rod, with a part of a support for the insertion nozzle, by which support the nozzle is mounted to pivot on the slay sole. This arrangement, in which the jack acts as a push-rod, allows the normal oscillation of the nozzle obtained by the effect of the single connecting-rod. In view of the high speed of the loom, it is advisable to choose a jack and means for controlling the latter, which have a very short response time, in order to facilitate virtually immediate ejection upon detection of a breakage of a thread (the time elapsing, in a cycle, between inspection of the warp or weft and the beginning of the insertion may be approximately 40 milliseconds). Advantageously, the action of the pneumatic jack and of the suction means is controlled simultaneously and by the same members, for the purpose of simplification and saving on compressed air, by providing that the jack is connected to a distributor by two pneumatic pipes, one of which comprises a branch pipe leading to the suction means. Preferably, the distributor is of the type comprising mechanical locking, in order to bring about the deflection and ejection of the weft thread not only upon stoppage of the loom, but also upon restarting the latter. As already mentioned, it is in fact desirable to eliminate insertion of the first pick on starting up the loom and by virtue of this arrangement, the elimination of the first pick is obtained even upon re-starting the loom after a long stoppage period, during which the electrical and pneumatic supply has been completely interrupted.

In order that a pick which has been eliminated by the means which have been described above is ultimately separated from the supply of weft thread, a fixed blade of the scissors for cutting the weft is extended by a lug to introduce the weft thread into the scissors at the time of the advance of the sley, after deflection and ejection of this thread by the pivoting of the nozzle and the actuation of the suction means.

BRIEF DESCRIPTION OF THE DRAWING

The invention will now be further described, by way of example, with reference to the accompanying diagrammatic drawing in which.

SPECIFIC DESCRIPTION

Figure 1:
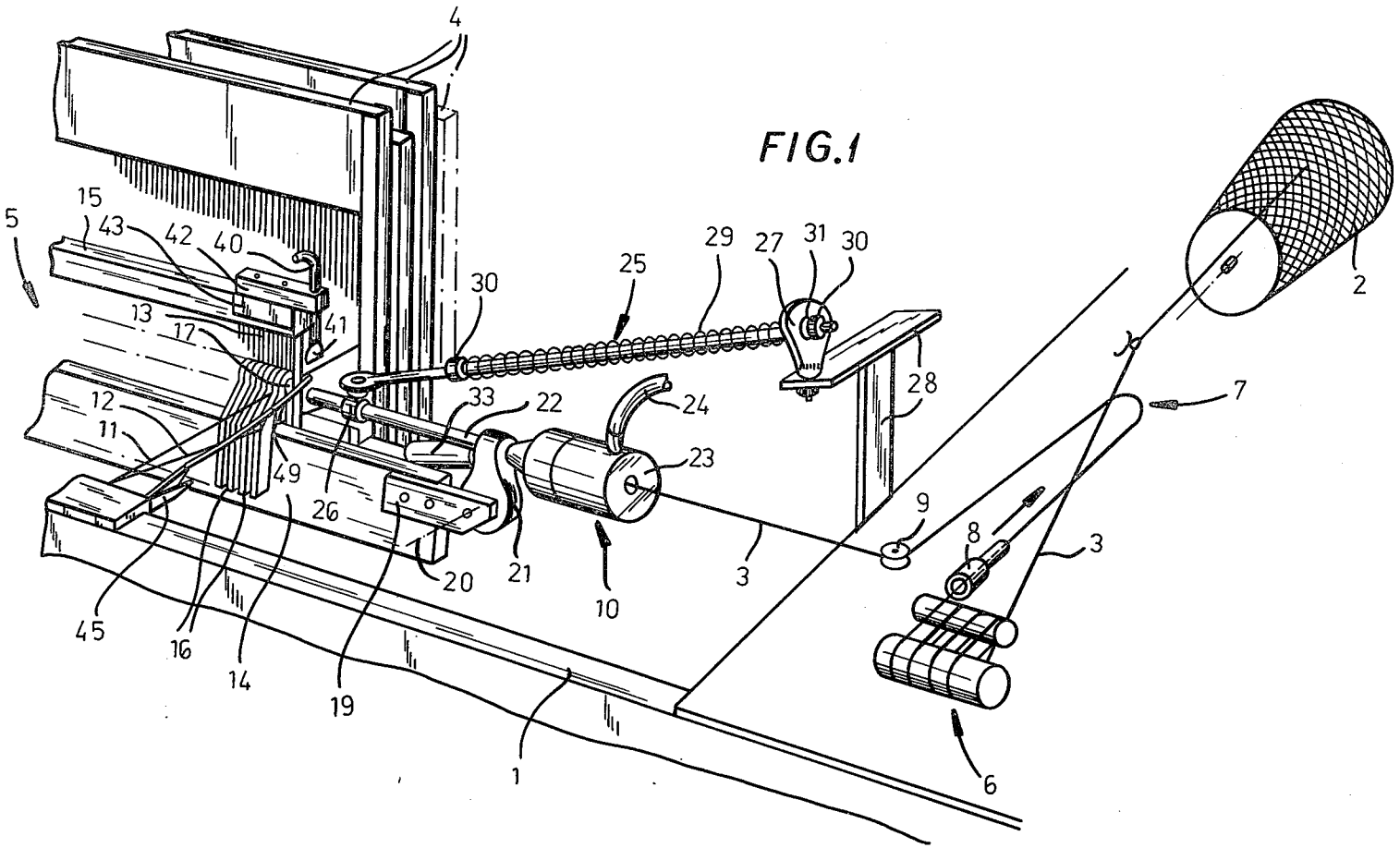
FIG. 1 is a fragmentary perspective view of a shuttleless weaving loom equipped with a device according to the invention, the weft insertion nozzle being shown in a non-tilted position for inserting the weft into a shed of warp threads.

FIG. 1 shows very diagrammatically, the side part of a shuttle-less loom with pneumatic insertion of the weft. This drawing shows the parts of the frame 1 of the loom, the fixed package 2 for supplying weft thread 3, the healds 4 and the sley 5. In known manner, the weft thread 3, unwinding from the package 2, is firstly supplied to a continuous delivering-measuring device 6, synchronized with the operating cycle of the loom. The weft thread 3 then forms a storage loop 7, under the effect of its passage through an auxiliary nozzle 8. After passing into the weft brake 9, the weft thread 3 enters the main nozzle 10 intended for its pneumatic insertion between the two sheets of warp threads 11 and 12.

Figure 4:
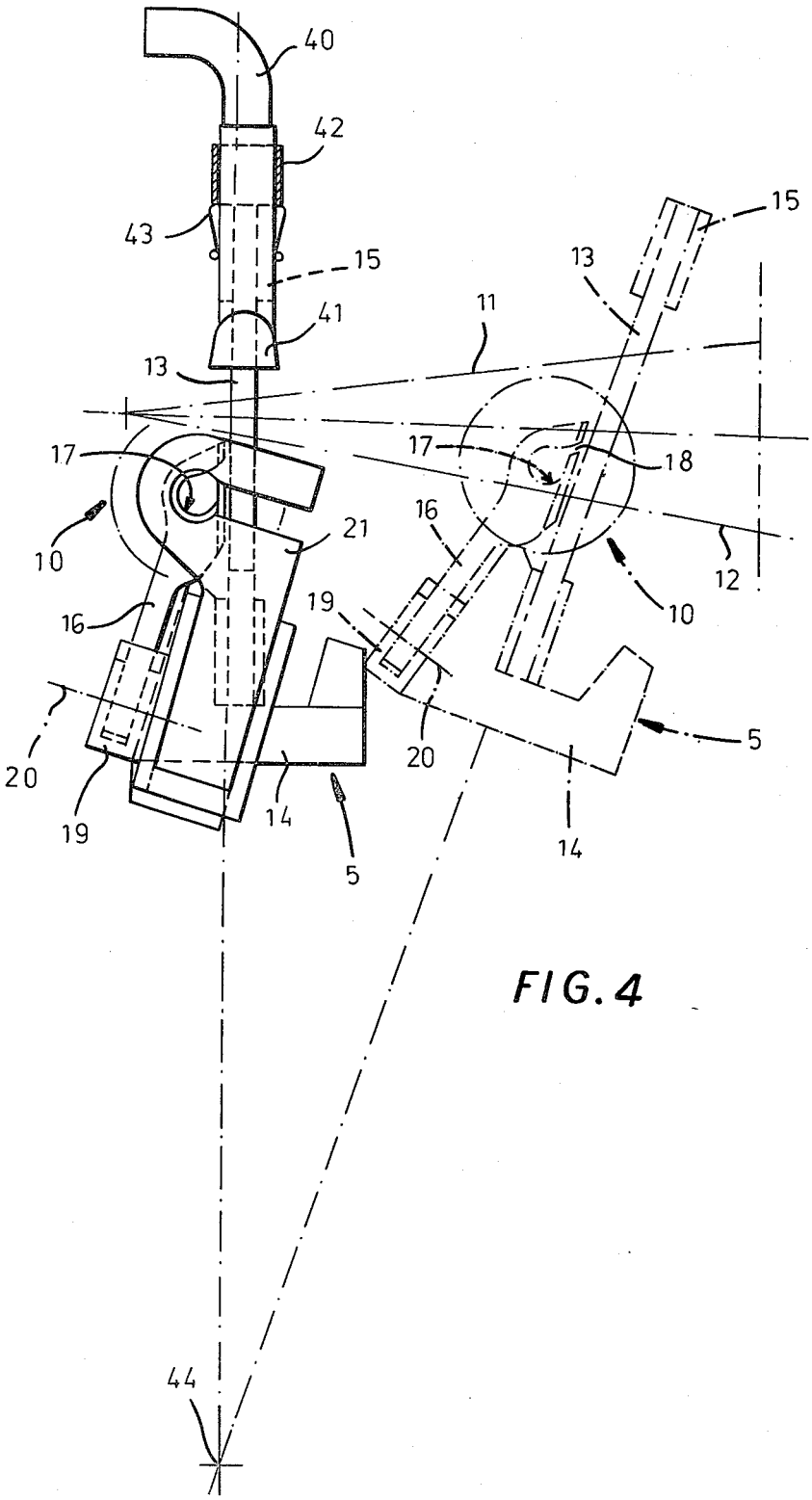
FIG. 4 is a diagrammatic and fragmentary end view of the sley of the loom in FIG. 1, in two positions, showing the nozzle on the sley sole.

The sley 5 comprises a reed 13 mounted on a reed support or sley sole 14 of U-shaped cross-section (see also FIG. 4). The reference numeral 15 designates the cap of the reed 13. Fixed against the front face of the sole 14 is a confiner 16 whose teeth may be separated by intervals greater than those separating the elements of the reed 13. Each of the teeth of the confiner 16 comprises an opening 17 of general circular shape, all these openings defining a channel through which the weft thread 3 is inserted. In known manner, certain teeth of the confiner 16 may comprise nozzles constituting "relays" in order to entrain the weft thread 3 during its insertion. Each opening 17 is connected to the outer edge of the corresponding teeth by a slot 18, in order to allow the pick inserted to leave the confiner 16 through all the slots 18, then through the gap provided between the elements of the reed 13 and those of the confiner 16.

On the side where the weft thread 3 is supplied, the sley sole 14 comprises an extension 19, on which the support 21 for the insertion nozzle 10 is mounted to pivot about a transverse axis 20 with respect to said sole. As shown in FIG. 4, this support comprises a U-shaped part, surrounding a tubular part 22 which extends a body 23 of the nozzle 10 to which a compressed air line 24 is connected.

A connecting rod 25 is mounted, by means of two swivel joints, between a first connecting member 26 fixed close to the free end of the tubular part 22 of the nozzle 10 and a second connecting member 27 carried by a support 28 fixed to the frame 1 of the loom. A coil spring 29, wound around the connecting rod 25, is compressed between the second connecting member 27 and one of two rings 30 clamped on connecting rod 25. The latter may slide through the swivel joint 31 which connects it to the fixed connecting member 27, the second ring 30 serving as a stop limiting the sliding movement.

Also mounted at the end of the sley sole 14, by means of a bent support 32 (see FIG. 5), is a small doubleacting pneumatic jack 33, the axis of which is designated generally by the reference numeral 34. The rod 35 of this jack 33, which is able to move along the axis 34, supports a head 36 which cooperates with a boss 37 provided on the support 21 for the insertion nozzle 10. The reference numerals 38 and 39 designate the pneumatic lines leading to the jack 33 and making it possible to supply the latter with compressed air for the extension or retraction of the rod 35.

At its end close to the insertion nozzle 10, the cap 15 of the reed 13 supports a suction tube 40 with an orifice 41. The tube 40 is held by a support 42, itself fixed to the cap 15 by means of a clamp 43.

Generally, the sley 5 oscillates about axis 44 (see FIG. 4) between a rear position for the insertion of the weft and a front position for beating-up and cutting of the weft by means of scissors 45.

In the insertion position illustrated in FIG. 1, the connecting rod 25, whose extension under the action of the spring 29 is maximum, gives the nozzle 10 a position parallel to the sley sole 14 and such that the orifice of said nozzle 10 is exactly opposite the entrance to the channel defined by the openings 17 of the teeth of the confiner 16. A pick may thus normally be inserted between the sheets of warp threads 11 and 12. This first position of the nozzle 10 is also shown in full line in FIG. 5.

Figure 2:
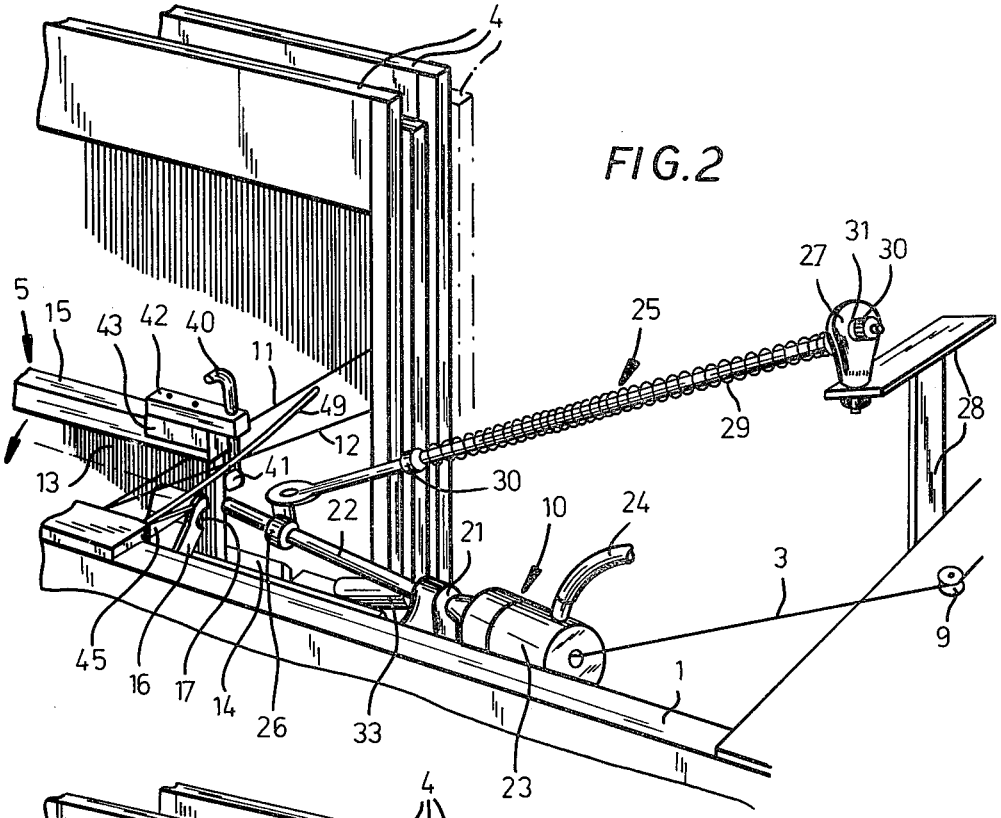
FIG. 2 is a perspective view corresponding to part of FIG. 1 showing the nozzle approaching its tilted position facilitating cutting of the weft.

After the insertion of a pick and during the pivoting of the sley 5 about its axis 44 towards the front (of FIG. 2), the arrangement formed by the nozzle 10 and by its support 21 pivots about the axis 20, on account of the connection of constant length ensured by the connecting rod 25, between the connecting member 26 integral with the nozzle 10 and the fixed connecting member 27. At the time of beating-up, the nozzle 10 will have pivoted for example through an angle of the order of 10°.

The free end of the tubular part 22 of the nozzle 10 has thus moved away from the scissors 45, in which the thread is engaged in order to be cut. Upon the return of the sley 5, the axis of the nozzle 10 will naturally be restored to an orientation parallel to the reed-support sole 14, in order to facilitate the insertion of the next pick. Thus, during normal operation of the loom, the general movement of the nozzle 10 is an oscillation about the axis 20.

Under circumstances which will be described hereafter, in which a pick is to be eliminated, i.e. not inserted between the sheets of warp threads 11 and 12, the jack 33 is actuated to produce the extension of its rod 35 and simultaneously a suction member 46 (of FIG. 6) is set in operation. The pneumatic circuits provided for this purpose comprise a distributor 47 of the 5/2 type with a double electric pilot and mechanical locking, controlled by pulses, which is connected on the one hand directly to the jack 33, by the lines 38 and 39 above mentioned and on the other hand to the suction means 46, by a branch 48 of the line 38.

Figure 3:
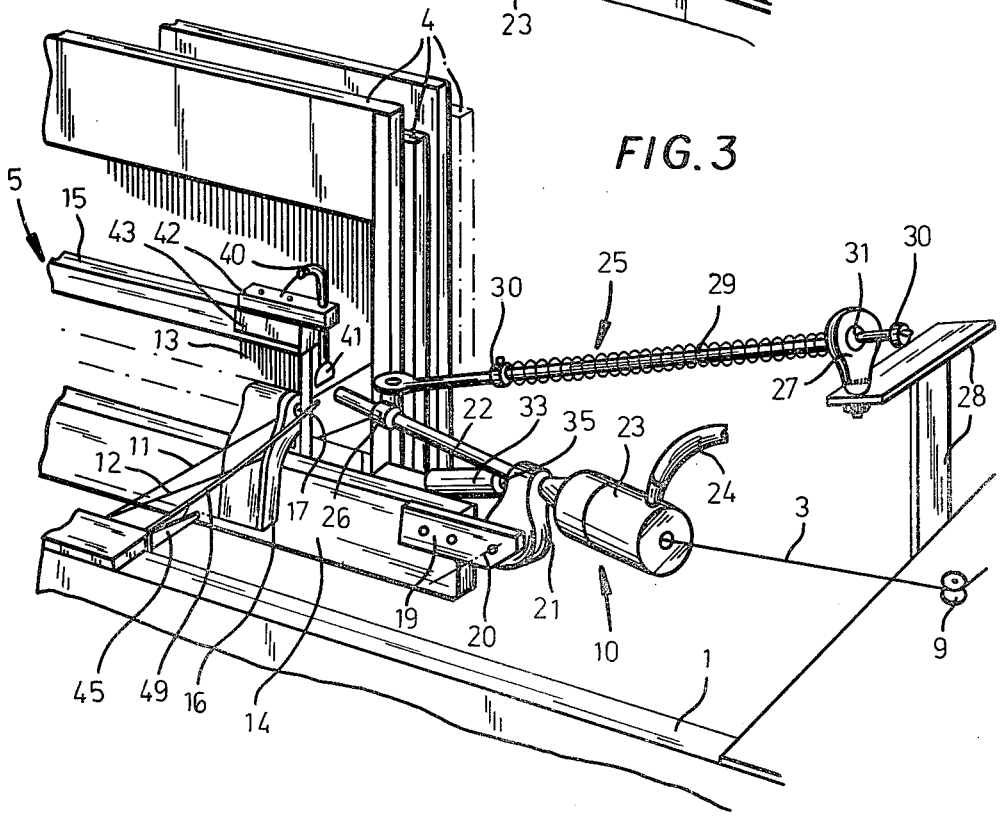
FIG. 3 is a perspective view similar to FIG. 2, but showing the nozzle in its tilted position for ejecting the weft.
Figures 5, 6:
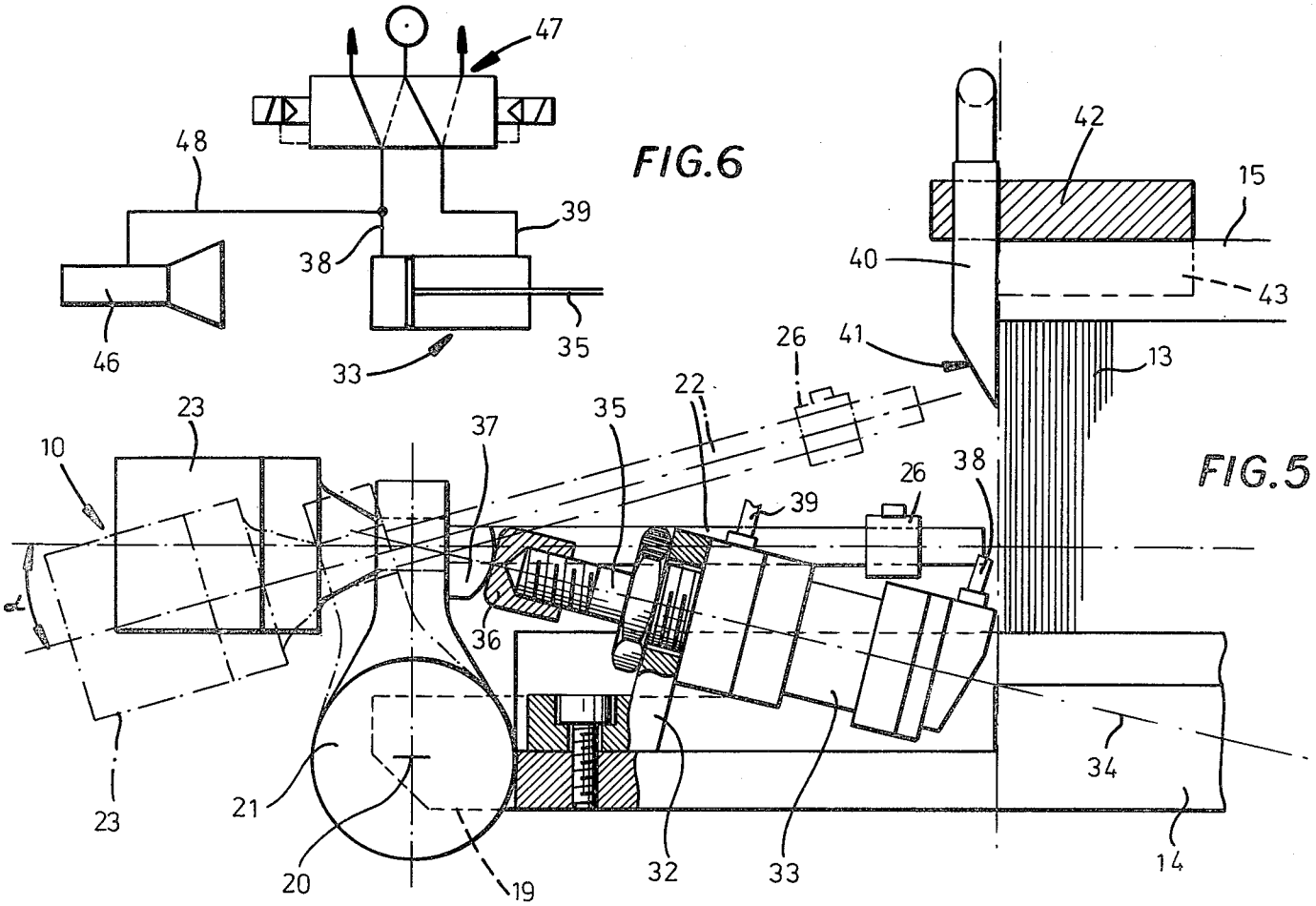
FIG. 5 is a fragmentary rear view, partially in section, of an end of the sley supporting the nozzle and jack for pivoting the nozzle.
FIG. 6 is a diagram of pneumatic circuits of the device formed according to the invention.

When the rod 35 of the jack 33 is extended, its head 36 pushes the boss 37 of the support 21, which causes the nozzle arrangement 10 to pivot about the axis 20, through an angle $\alpha$ of the order of 15° for example (of FIG. 5). This pivoting of the nozzle 10 is accompanied by a retraction of the connecting rod 25, the spring 29 being compressed and the connecting rod sliding through the swivel joint 31, so that the distance between the two connecting members 26 and 27 decreases (of FIG. 3). The free end of the tubular part 22 is no longer located opposite the entrance to the channel defined by the openings 17 in the teeth of the confiner 16, but the orifice of the nozzle 10 is in the proximity of the inlet orifice 41 of the suction mouthpiece 40. Instead of being inserted normally, the weft thread 3 is thus deflected and directed into the orifice 41 of the mouthpiece 40, which in turn directs the thread towards the suction member 46. It should be noted that this suction member 46, connected by the branch 48 to the line 38, is in this case stationary. The mouthpiece 40 comprises a bend (see FIG. 1 to 5), located opposite the entrance to the suction means 46 (FIG. 6), this solution providing simplification in that it eliminates a flexible pipe.

It should be noted that at the time of controlling the jack 33, the nozzle 10 may be slightly inclined under the action of the connecting rod 25. In this case, the jack 33 operates "on no load" during the beginning of the extension of its rod 35. During a second stage, the head 36 of the rod 35 causes the nozzle 10 to pivot completely and simultaneously causes the retraction of the connecting rod 25. In all cases, the nozzle 10 will reach a position of maximum inclination $\alpha$, defined by a stop and such that the weft thread 3 is directed into the mouthpiece 40 fixed on the reed 13. Then, throughout the entire ejection, the nozzle 10 remains in a fixed position with respect to the mouthpiece 40.

At the end of the ejection, the weft thread 3 is stretched between the nozzle 10 and the mouthpiece 40. During the forwards movement of the sley 5, this thread is guided by a lug 49 which extends the fixed blade of the scissors 45, in order to be finally engaged in the scissors 45 and to be cut by the latter.

Figure 7:
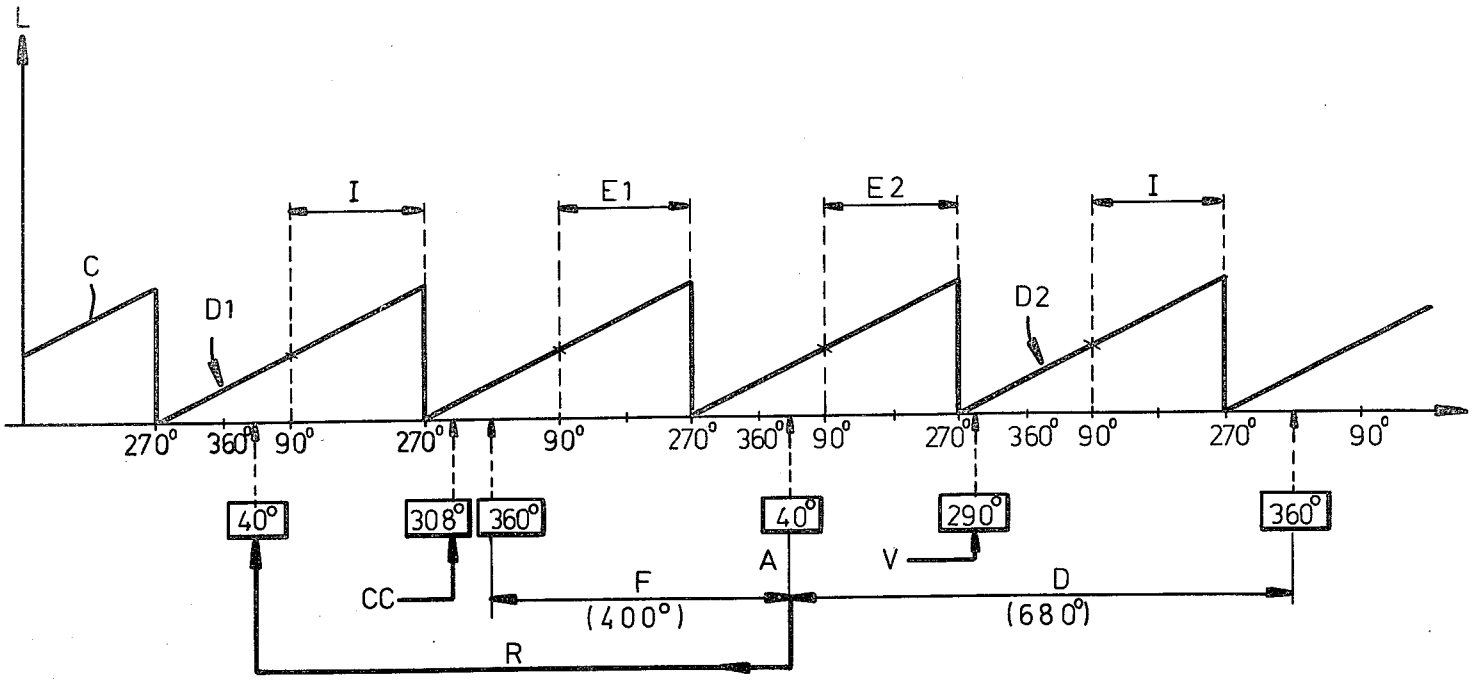
FIG. 7 is a diagram illustrating the intervention of the device according to the invention, on a loom, in the case of stoppage of the loom due to a breakage of a warp thread or when controlled manually.
Figure 8:
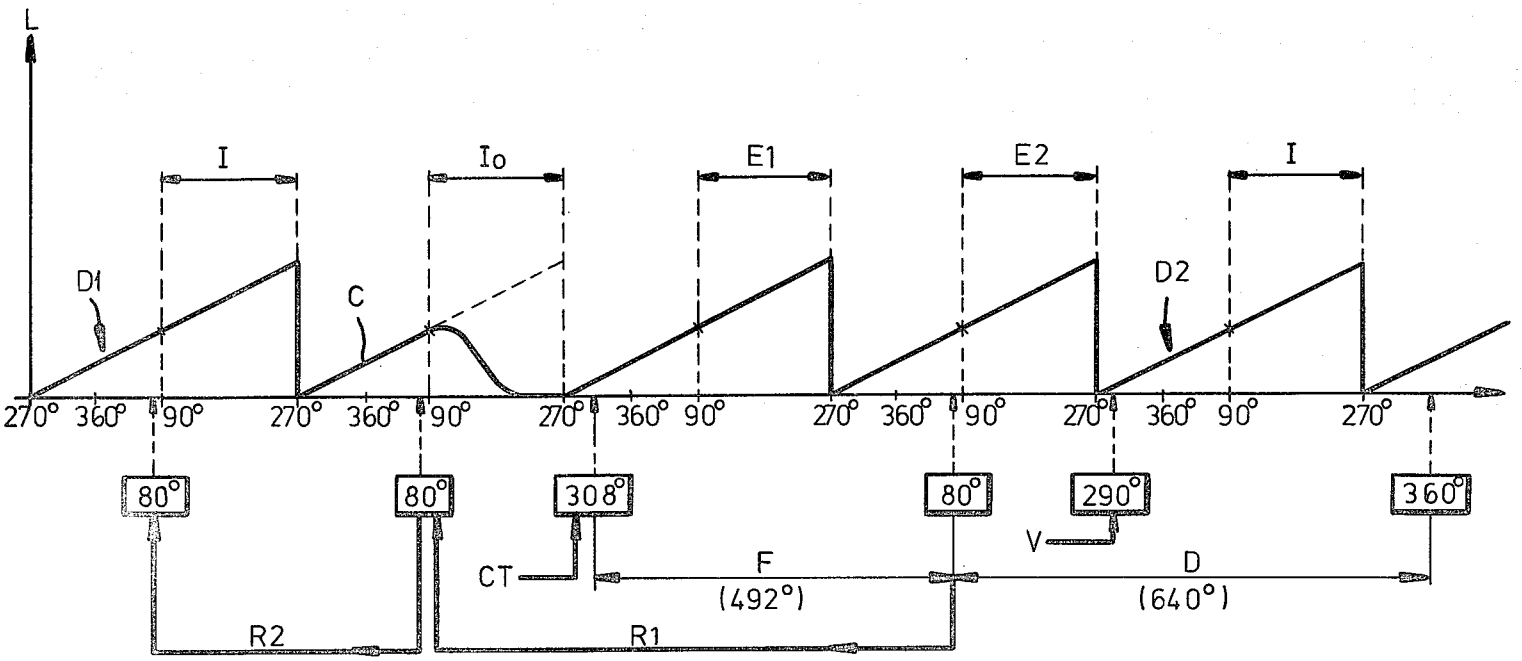
FIG. 8 is a diagram of the same type as FIG. 7 but showing intervention of the device in the case of stoppage of the loom due to the breakage of the weft thread.

The diagrams of FIG. 7 and 8 explain the intervention of the device according to the invention and in particular the ejection of the weft thread, in relation to the cyclic operation of the loom. This operation is symbolized by a curve C, whereof the X-axis corresponds to the angular position of the loom and whereof the Y-axis represents the length of weft unwound L. The curve C has a "sawtooth" shape, explaining the fact that the weft thread unwinds continuously, thus throughout each cycle. Owing to the storage of the weft thread 3, in the form of the loop 7 (see FIG. 1), the duration of insertion symbolized by I extends over a half cycle, between the positions 90° and 270° (the position 0° or 360° corresponding to the beating-up instant). Under normal operation, the insertion nozzle 10 should be located parallel to the reed-support sole 14 from the 90° position corresponding to the beginning of the insertion period I. After each insertion of a pick, the warp inspection CC and the weft inspection CT take place simultaneously, for example on passing through the 308° position. The periods of deceleration F and starting-up D, before and after a stoppage in a predetermined angular position designated by A, are greater than the duration of one cycle of the loom.

We shall firstly consider the case of a stoppage due to the breakage of a warp thread, detected by the inspection CC (see FIG. 7) after the normal insertion of the last pick D1. Deceleration F begins at the 360° position corresponding to beating-up of this last pick D1 and it extends over 400°, the stoppage position A in this case corresponding to 40°. It is advisable to eject, as shown by E1, the following pick which would have been inserted during the period of deceleration F. The insertion nozzle 10 should thus be moved by the jack 33, between the warp inspection *CC* (at 308°) and the beginning of the next insertion (at 90° in the following cycle). At the time of the stoppage A, the loom is automatically moved two steps back, as indicated by the arrow R.

Starting-up D in this case takes place over 680° C., from the stoppage position A at 40°. This starting-up D covers two insertion periods, but the first pick is ejected as shown by E2 (this second ejection justifying the return R by two steps backwards), so that the second pick D2 will in fact be the first pick inserted. The ejection E2 is obtained by the mechanical locking of the distributor 47, which keeps the rod 35 of the jack 33 in the extended position during the stoppage A of the machine. After this ejection E2, the first beating-up operation will take place on the last pick D1, inserted before the stoppage of the machine. Furthermore, a sensor V for example checks the first passage through the 290° position, after re-starting, in order to control the distributor 47, in order to bring about the retraction of the rod 35 of the jack 33, in order that the nozzle 10 resumes its normal non-tilted position before the insertion of the pick D2.

The details given above, with reference to the diagram of FIG. 7, remain valid when the loom is stopped manually.

Referring to FIG. 8, we shall now consider the case of a stoppage due to the breakage of the weft thread, detected by the CT inspection which is ensured by a "weft-breaking detector" located beside the loom opposite the insertion nozzle 10. As previously, D1 designates the last pick normally inserted. Io in this case represents the insertion which has not taken place correctly, owing to the fact that the weft thread has broken.

Deceleration F begins immediately upon the detection of the break (thus at the 308° position) and it extends over 492°, the stopped position A in this case corresponding to 80°. As shown at E1, the pick which would have been inserted during the braking period F is ejected, the nozzle 10 previously having been tilted by the jack 33. At the time of the stoppage A (at 80°), the machine is automatically moved back by two steps, as shown by the arrow R1. When the machine is stopped and after this backwards movement, one proceeds with the intervention intended to eliminate the broken weft. Then an additional backwards movement by one step is controlled manually, as shown by the arrow R2, in order to have the last complete pick D1 in position.

Starting-up D in this case takes place over 640°, starting from the stopped position A at 80°. As previously, this starting-up D covers two insertion periods, but the first pick is ejected as shown by E2, so that the second pick D2 will be the first pick inserted. The initial retention of the nozzle in the tilted ejection position, then its return to the normal insertion position, are obtained as already described above.

Naturally, the invention is not limited to the single embodiment of this device comprising a movable insertion nozzle, which was described above, by way of example. On the contrary, it includes all variations based on the same principle. Thus, in particular, it would not be outside the scope of the invention to provide modifications to details relating to the connecting rod 25, the jack 33 or it supply circuits and clearly the angular values, given previously and relating to a particular type of loom, are not intended as restrictions.

What is claimed is:

1. A device for the pneumatic insertion of a weft in a shuttle-less weaving loom having a sley with a sley sole, said device comprising a pneumatic insertion nozzle mounted to pivot on an extension of said sley sole about an axis perpendicular to said sley sole, a connecting rod separate from said nozzle and pivotally connected to said nozzle and to a fixed point of the loom at spaced apart locations along the length of the rod so that the nozzle has a position parallel to the sley sole during the insertion of the weft thread, but forms an angle with respect to the longitudinal direction of the sley sole in a beating-up position of the sley.

2. The device defined in claim 1 wherein the connecting rod is mounted, through the intermediary of swivel joints, between a first connecting member fixed to a tubular part of the insertion nozzle and a second connecting member carried by a support fixed to a frame of the loom.

3. The device defined in claim 1 or claim 2 wherein the extension of the sley sole also supports a jack, said jack being able to control the pivoting of the insertion nozzle about said axis in order to deflect the weft thread and so as not to insert the weft thread between sheets of warp threads when a fault is detected causing the deceleration and stoppage of the loom, the connecting rod being retractable in order to facilitate the pivoting of the insertion nozzle under the control of said jack, in any position of the sley.

4. The device defined in claim 3 wherein the jack is a double acting pneumatic jack having a rod supporting a head which cooperates, in the manner of a push-rod, with a part of a support for the insertion nozzle, by which support the insertion nozzle is mounted to pivot on the sley sole.

5. The device defined in claim 3 wherein the connecting rod is mounted to slide through one of said swivel-joints which connects it to the fixed second connecting member, a spring mounted around said connecting rod normally keeping at a maximum extension of the spring but being compressible to allow the pivoting of the insertion nozzle under the control of the jack.

6. The device defined in claim 5 wherein suction means are mounted on the reed, said suction means are able to ensure the ejection of the weft thread when the latter is not inserted between the sheets of warp threads, the pivoting of the insertion nozzle under the control of the jack bringing an orifice of the insertion nozzle into the vicinity of an inlet orifice of the suction means.

7. The device defined in claim 3 wherein suction means are mounted on the reed, said suction means are able to ensure the ejection of the weft thread when the latter is not inserted between the sheets of warp threads, the pivoting of the insertion nozzle under the control of the jack bringing the orifice of an insertion nozzle into the vicinity of an inlet orifice of the suction means.

8. The device defined in claim 7 wherein the pneumatic jack controlling the pivoting of the insertion nozzle is connected to a distributor by two pneumatic lines whereof one comprises a branch leading to a suction member.

9. The device defined in claim 8, wherein the distributor is of a type comprising mechanical locking, in order to bring about deflection and ejection of the weft thread not only upon stoppage of the loom but also at the time of re-starting of the loom.

10. The device defined in claim 8 wherein a fixed blade of a scissors for cutting the weft is extended by a lug to bring the weft thread into the scissors upon the forwards movement of the sley, after deflection and ejection of the weft thread by the pivoting of the insertion nozzle and the actuation of the suction means.

11. The device defined in claim 7 wherein a fixed blade of a scissors for cutting the weft is extended by a lug to bring the weft thread into the scissors upon the forwards movement of the sley, after deflection and ejection of the weft thread by the pivoting of the insertion nozzle and the actuation of the suction means.

12. The device defined in claim 7 wherein the jack is a double acting pneumatic jack having a rod supporting a head which cooperates, in the manner of a push-rod, with a part of a support for the insertion nozzle, by which support the insertion nozzle is mounted to pivot on the sley sole.

* * * * *